United States Patent [19]

Hikobe et al.

[11] 4,133,088

[45] Jan. 9, 1979

[54] ROOM TEMPERATURE CRIMPING OF FIBRILLATED FILM MATERIAL

[76] Inventors: Kokichi Hikobe; Kyoichi Hikobe, both of 1-873 6 chome Hirosawa-cho, Kiryu-shi, Gunma-ken, Japan

[21] Appl. No.: 804,274

[22] Filed: Jun. 7, 1977

[30] Foreign Application Priority Data

Jun. 10, 1976 [JP] Japan ..... 51-68063

[51] Int. Cl.[2] ..... D02G 1/14; D02G 3/22

[52] U.S. Cl. ..... 28/279; 264/DIG. 47; 264/168; 428/369; 210/DIG. 26

[58] Field of Search ..... 264/147, DIG. 47, 168; 428/369; 28/279

[56] References Cited

U.S. PATENT DOCUMENTS

| | | | |
|---|---|---|---|
| 2,392,582 | 1/1946 | Kadt | 28/279 |
| 2,627,644 | 2/1953 | Foster | 28/279 |
| 2,668,564 | 2/1954 | Laros | 28/279 |
| 3,041,706 | 7/1962 | Bromley et al. | 28/279 |
| 3,421,193 | 1/1969 | Taylor | 28/279 |
| 3,496,260 | 2/1970 | Guenther et al. | 264/147 |
| 3,550,826 | 12/1976 | Salmela | 264/DIG. 47 |
| 3,883,936 | 5/1975 | Stanley | 28/265 |

FOREIGN PATENT DOCUMENTS

| | | | |
|---|---|---|---|
| 1903650 | 9/1969 | United Kingdom | 28/279 |

OTHER PUBLICATIONS

Anon, Textile Month, Nov. 1970, p. 76.

*Primary Examiner*—J.C. Cannon

*Attorney, Agent, or Firm*—Haseltine, Lake & Waters

[57] ABSTRACT

A crimp finished yarn wherein a mesh like structure consisting of a large number of thick filaments and a large number of thin filaments intersecting with the large number of thick filaments is formed by opening an elongated thermoplastic synthetic resin film by means of an opener, for example, by causing the film to pass between a pair of vertically disposed card clothing rollers and then this film is made to pass through a tooth-shaped roller forming a crimp applying device and a friction roller at room temperature whereby the molecular arrangement of the surface making slidable contact with the tooth-shaped roller is changed with the friction passing and compression process to form a different layer condition, and at the same time, crimps of saw-tooth condition are produced, whereby a mesh like crimped fiber structure formed by the large number of crimped thick filaments and crimped thin filaments is provided.

6 Claims, 3 Drawing Figures

ROOM TEMPERATURE CRIMPING OF FIBRILLATED FILM MATERIAL

FIELD OF THE INVENTION

The present invention relates to a novel crimp finished yarn using thermoplastic synthetic resin film as a starting material, and more particularly to the crimp finished yarn using the thermoplastic synthetic resin as the starting material, but the crimp is produced by the process at room temperature without applying any heat treatment.

PRIOR ART

Heretofore, as methods of manufacturing the crimp finished yarn using the thermoplastic synthetic resin film as the starting material, there have been proposed various methods such as knife edge crimp method, stuffer box method, crinkle yarn method, and air jet method, but these manufacturing methods utilize characteristic properties of the starting material to be processed, namely, thermoplastic properties to apply crimp to the material, and therefore a separate heating source device is required, and moreover it is necessary to maintain the application of heat to the processed material at a constant temperature, and since temperature and moisture change depending on natural conditions such as change of seasons, and as a result, adjustment of the heat applied to the processed material is extremely difficult, and also the heat cannot be applied uniformly to the entire processed material. For this reason, the unevenness of product due to lack of stability of the crimp of the processed material, and particularly, dye disproportion results after the dyeing is made, and also in addition to the unstable crimp, the mode of crimp is of moderate waveform, the crimp tends to deteriorate as time elapses, and it lacks the natural fiber-like taste, tremendously spoiling the commercial value as the crimp finished yarn.

SUMMARY OF THE INVENTION

The present invention eliminating all the drawbacks involved with the currently employed methods, and its primary object is to provide a crimp finished yarn using the thermoplastic synthetic resin as the starting material without utilizing its characteristics or the thermoplastic properties, that is, without performing the heat treatment to produce crimp at room temperature.

Another object of the present invention is to provide a crimp finished yarn having extremely high stability of crimp and solidity and not causing deterioration in the crimp as time elapses and having a taste similar to that of natural fibers and producing no dye disproportion after dyeing.

A still further object of the present invention is to provide a crimp finished yarn which can be utilized as an oil adsorbing material to treat outflowed oil or oil containing drainage which is one of the most important problems which have not been solved as regards industrial pollution.

BRIEF DESCRIPTION OF DRAWINGS

The drawings illustrate an embodiment of the crimp finished yarn according to the present invention, wherein.

DETAILED DESCRIPTION OF INVENTION

Other objects and advantages of the invention will become apparent from the following detailed description of an embodiment of the invention when considered together with the attached drawings.

Figure 1:
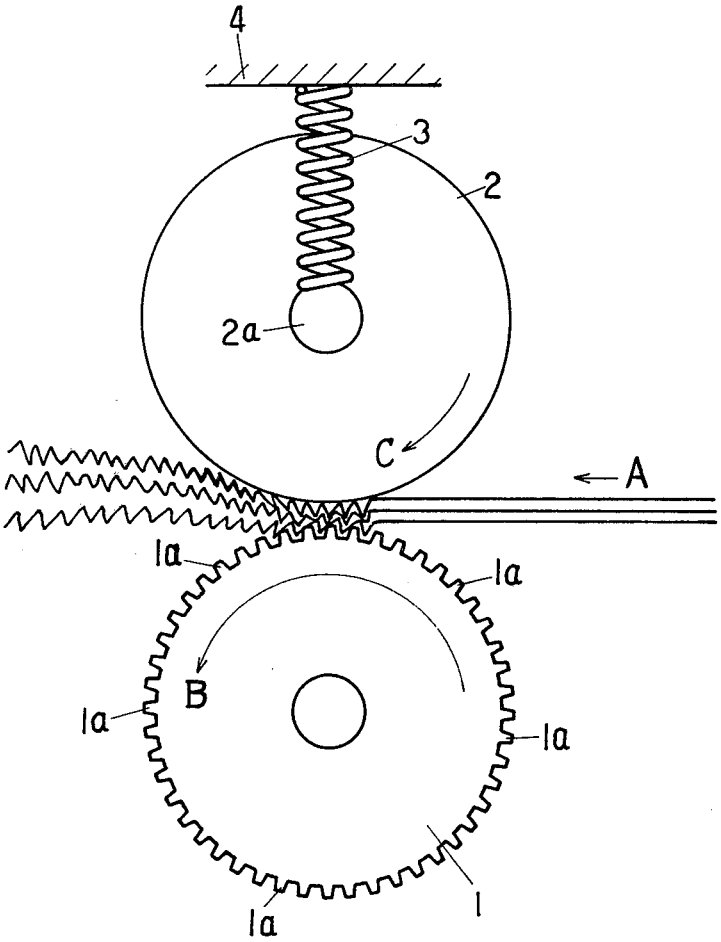
FIG. 1 is a schematic view of a device for applying crimp to film.

FIG. 1 shows a schematic view of an essential part of a device for applying crimp to the film, wherein the crimp applying device is constructed in such a way that a pair of vertically disposed rollers 1, 2 are rotatably disposed in opposition which are located at the side of the end of the delivery of an opener (not shown) consisting of a pair of vertically disposed card clothing rollers, and the lower roller 1 is formed with a plurality of thin teeth 1*a*, 1*a* . . . on its peripheral surface. The upper roller 2 is formed of synthetic resin having high friction properties. The tooth-shaped roller 1 and the friction roller 2 have different peripheral speeds, and the tooth-shaped roller 1 is set to rotate at a high speed as compared with the friction roller 2. Reference numeral 3 denotes a spring for adjustment of the friction roller 2, and the spring 3 is perpendicularly mounted between a rotating shaft 2*a* of the friction roller 2 and a machine frame 4. Numeral 5 denotes an opened thermoplastic synthetic resin film, and 5' denotes a thermoplastic synthetic resin film which has been crimp finished.

In the foregoing embodiment, the tooth-shaped roller is positioned in the lower position and the friction roller 2 is positioned in the upper position so that the rollers are opposed to each other, but the rollers may be disposed in opposition in reverse. Also, if the rotating speed of the sliding contact surface of the tooth-shaped roller 1 and the friction roller 2 against the film 5 is maintained at a proper ratio, the friction roller 2 may be fixed.

Figure 2:
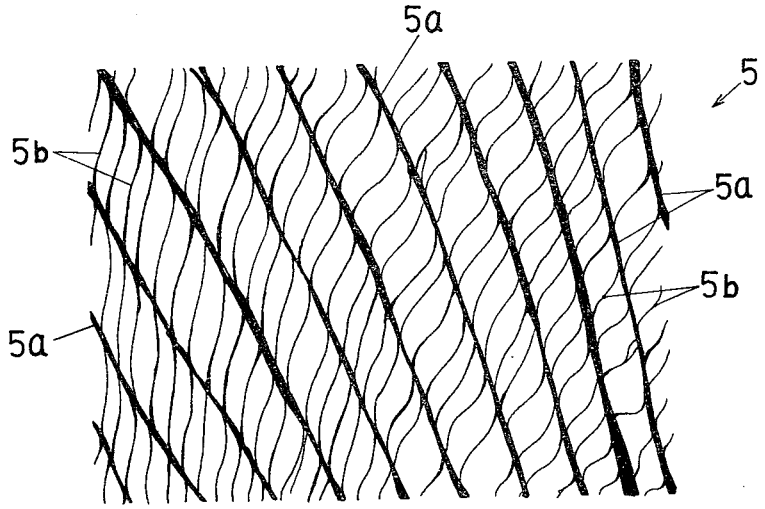
FIG. 2 is an enlarged plan view showing a mode of the opening.

In the construction is described in the foregoing, when the film 5 which has been elongated in a predetermined ratio is made to pass between the pair of vertically disposed card clothing rollers forming the opener and the film 5 is opened, the film 5 is thinly divided into the condition of mesh like structure consisting of a large number of thick filaments 5*a* generated in the elongation direction and a large number of thin filaments 5*b* which intersect the large number of thick filaments as shown in FIG. 2.

Figure 3:
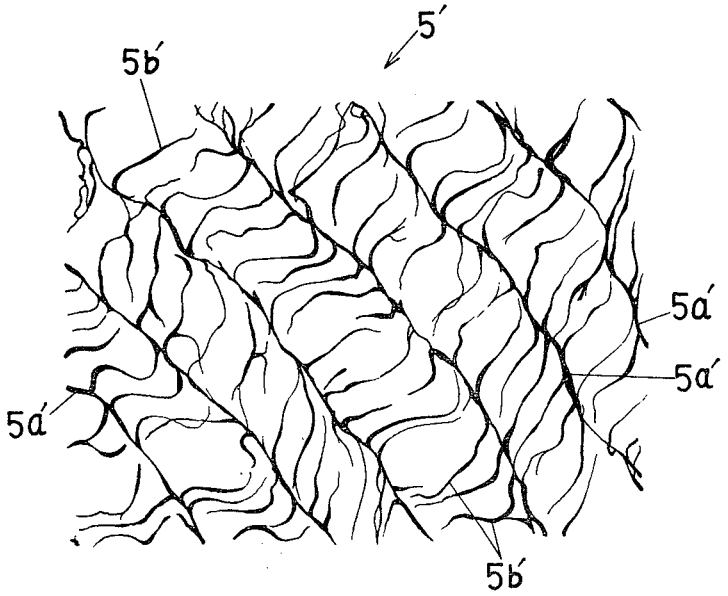
FIG. 3 is an enlarged plan view showing a mode of the crimping.

The opened film 5 as described above is fed between the tooth-shaped roller 1 and the friction roller 2 of the crimp applying device positioned at the side of the delivery end of the opener (in the direction shown in FIG. 1). The tooth-shaped roller 1 and the friction roller 2 rotate in mutually opposite directions (arrows B, C in FIG. 1), and the tooth-shaped grooves 1*a*, 1*a* . . . of the tooth-shaped roller 1 rotate at a higher speed than that of the peripheral surface of the friction roller 2, whereby the under surface of the film 5 undergoes the force of the delivery direction by the tips of the tooth-shaped grooves 1*a*, 1*a* . . . in the delivery process by the tooth-shaped roller 1 and the friction roller 2, and the upper surface undergoes the resisting force of the reverse direction by the friction roller 2 as a result, the lower surface of the film 5, namely, the molecular arrangement of the surface that slidably contacts the tooth-shaped roller 1 changes in the friction passing and compression process between the tooth-shaped roller 1 and the friction roller 2 to produce a different layer condition, and at the same time, it undergoes a crimping action so as to be crimped in saw-tooth shape, and as shown in FIG. 3, a crimp finished yarn having a mesh like crimp fiber structure consisting of a large number of thick crimped filaments 5'*a* and a large number of thin crimped filaments 5'*b* can be obtained. In this case, the saw-tooth like crimp is generated uniformly on the entire surface when the film 5 passes between the tooth-shaped roller 1 and the friction roller 2, and as friction heat is generated locally, a crimp having immensely high stability and solidity can be obtained, and at the same time, as the large number of thin filaments 5'*b* which are branched from the thick filaments 5'*a* which are disengaged from the mesh are sharpened successively as they go toward the tips from the branched base ends, the filaments have a taste similar to that of natural fiber, and yet after dyeing, it produces no dye disproportion at all, and there is no deterioration in the crimp as time elapses.

In short, the crimp finished yarn according to the present invention forms a mesh like structure consisting of a large number of thick filaments and a large number of thin filaments intersecting with the large number of thick filaments, and the molecular arrangement of only one surface of both surfaces of the film is made to change at room temperature in the frictional passing and compression process to produce a different layer condition, and at the same time, the saw-tooth like crimp is produced. As the crimp finished yarn is made of a mesh like crimp fiber structure consisting of a large number of crimped thick filaments and a large number of crimped thin filaments, even though the crimp finished yarn using the thermoplastic synthetic resin as the starting material, it does not require heat treatment at all, and yet it has a taste similar to that of natural fiber, and has tremendously high stability and solidity of the crimp. Namely, the present invention is an entirely novel crimp finished yarn having many possibilities and creativity and a wide range of size of filament.

From the above-mentioned characteristics, the crimp finished yarn according to the present invention can be knitted or woven or used to form union cloth or union knit cloth using other fibers so that the crimp finished yarn according to the present invention can be utilized widely in such industrial fields as the treatment of outflowing oils, oil containing drainage, agricultural materials, construction materials. Particularly, for the removal of outflowing oil, this crimp finished yarn has outstanding performance, and according to test performance obtained in the test conducted by Textile Industry Test Center established by Gumma Prefecture, it shows a remarkably high oil absorbing rate, almost 47 times by weight, which indicates that this crimp finished material can be utilized as an epoch making absorbing material capable of contributing to the solution of outflowing oil removal which is an unsolved important pollution problem.

Test of Performance by Oil Absorbing Material

1. Method of test:

Test material: Sliver like material

Heavy oil: B heavy oil (kinematic viscosity of heavy oil is 6.33 centistokes at 50° C.)

B heavy oil was placed for 5 minutes in the oil at 25° C., and then it was left out for 5 minutes on a metal screen formed in mesh form with a 1 mm dia and mesh length of 17 mm, and the weight was measured.

2. Test performance:

| No. | sample after treatment + weight of beaker | weight of beaker | weight of sample after treatment | weight of sample before treatment | amount of absorbed oil | amount of absorbed oil/g |
|---|---|---|---|---|---|---|
| | A | B | A-B | C | A-B-C | (A-B-C)/C |
| 1 | 62.4193 | 35.5100 | 26.9093 | 0.5997 | 26.3096 | 43.871 |
| 2 | 61.5273 | 35.4357 | 26.0916 | 0.5523 | 25.5393 | 46.241 |
| 3 | 94.6954 | 68.4830 | 26.2124 | 0.5210 | 25.6914 | 49.311 |
| 4 | 91.7850 | 63.7953 | 27.9897 | 0.5624 | 27.4273 | 48.768 |
| 5 | 53.2380 | 37.2161 | 16.0219 | 0.3568 | 15.6651 | 43.904 |
| 6 | 55.2487 | 37.1536 | 18.0951 | 0.3831 | 17.7120 | 46.233 |
| 7 | 54.8369 | 39.0843 | 15.7526 | 0.3247 | 15.4279 | 47.514 |
| 8 | 83.0431 | 65.6879 | 17.3552 | 0.3694 | 16.9858 | 45.982 |
| Total | 556.7937 | 382.3659 | 174.4278 | 3.6694 | 170.7584 | 371.824 |
| Average | 69.5992 | 47.7957 | 21.8034 | 0.4586 | 21.3448 | 46.478 |

Many modifications may be made by those who desire to practice the invention without departing from the scope thereof which is defined by the appended claims.

What is claimed is:

1. A method of producing a crimp-finished yarn comprising passing a mesh-like fiber structure formed from a thermoplastic film between a pair of opposed rollers, said fiber structure having longitudinally extending relatively thick filaments and transversely extending relatively thin filaments, one of said rollers being formed with teeth on its periphery and the other of the rollers being smooth and constituted as a friction roller, providing relative rotation between said rollers such that the roller with teeth has a relative peripheral velocity with respect to the surface of the friction roller, said fiber structure being passed through said rollers at room temperature and being engaged by the roller with teeth at one surface thereof and subjected to the advancing action thereof due to the rotation of said roller while the opposite surface of the fiber structure is subjected to a resisting force due to the engagement thereof with the friction roller such that the differential action of the rollers produces differential layer conditions in the fiber structure concurrently with the formation of saw-tooth crimps in said fiber structure at room temperature.

2. A method as claimed in claim 1 comprising resiliently urging said rollers together.

3. A method as claimed in claim 1 wherein both rollers are rotated in the same direction at different speeds.

4. A method as claimed in claim 3 wherein the linear velocities at the peripheries of the rollers at the nip thereof extends in the direction of advance of the fiber structure.

5. A method as claimed in claim 1 wherein a large number of thin filaments are branched from the thick filament during crimping, the branched filaments sharpening successively from the base ends to the tip.

6. A method as claimed in claim 5 wherein said crimp finished yarn has an oil adsorption capability of more than 40 times by weight.

* * * * *